US011882938B2

(12) United States Patent
Yang

(10) Patent No.: US 11,882,938 B2
(45) Date of Patent: Jan. 30, 2024

(54) METHOD FOR PACKAGING BED

(71) Applicant: YICHUN YUHONG FURNITURE CO., LTD., Yichun (CN)

(72) Inventor: Bo Yang, Tianmen (CN)

(73) Assignee: YICHUN YUHONG FURNITURE CO., LTD., Yichun (CN)

( * ) Notice: Subject to any disclaimer, the term of this patent is extended or adjusted under 35 U.S.C. 154(b) by 0 days.

(21) Appl. No.: 17/987,804

(22) Filed: Nov. 15, 2022

(65) Prior Publication Data

US 2023/0190004 A1 Jun. 22, 2023

Related U.S. Application Data

(62) Division of application No. 17/690,001, filed on Mar. 9, 2022, now Pat. No. 11,540,641.

(30) Foreign Application Priority Data

Dec. 16, 2021 (CN) ..... 202123194287.0
Feb. 17, 2022 (CN) ..... 202210147577.X

(51) Int. Cl.
*A47C 19/02* (2006.01)
*B65B 5/08* (2006.01)
*B65B 35/50* (2006.01)

(52) U.S. Cl.
CPC ..... *A47C 19/022* (2013.01); *B65B 5/08* (2013.01); *B65B 35/50* (2013.01)

(58) Field of Classification Search
CPC ..... A47C 19/022; A47C 19/005; A47C 7/407; A47C 7/42; A47C 7/405; A47C 19/04; F16B 5/0004; F16B 5/002; F16B 5/02; F16B 5/004; A47D 7/005; A47D 7/01; A47G 1/065; B65B 5/08; B65B 35/50
See application file for complete search history.

(56) References Cited

U.S. PATENT DOCUMENTS 8,931,123 B1 * 1/2015 Oh ..... A47C 23/06 5/280
2009/0288253 A1 * 11/2009 Jin ..... A47C 19/022 5/285

(Continued)

FOREIGN PATENT DOCUMENTS

CN 213696332 U 7/2021

*Primary Examiner* — Justin C Mikowski
*Assistant Examiner* — Alison N Labarge

(57) ABSTRACT

A method for packaging a bed includes disassembling a headboard into a first headboard, a second headboard, a third headboard, and a fourth headboard; placing one of the first headboard and the second headboard with a back thereof facing upward; placing one of the first headboard and the second headboard with a back thereof facing upward to allow an opening of a first accommodating groove or a second accommodating groove on the back thereof to face upward; placing the third headboard and the fourth headboard side by side with a back facing upward into the accommodating groove, allowing openings of a third accommodating groove and a fourth accommodating groove to face upward; placing stacked slats into the third accommodating groove and the fourth accommodating groove, and placing a first transverse keel, a second transverse keel, and support legs into the third accommodating groove and the fourth accommodating groove.

2 Claims, 10 Drawing Sheets

(56) References Cited

U.S. PATENT DOCUMENTS

| | | | | |
|---|---|---|---|---|
| 2017/0071355 | A1* | 3/2017 | Oh | A47C 17/82 |
| 2017/0086595 | A1* | 3/2017 | Chen | A47C 19/005 |
| 2021/0282564 | A1* | 9/2021 | Chen | A47C 19/005 |
| 2023/0042530 | A1* | 2/2023 | Bengtsson | A47C 19/022 |

* cited by examiner

METHOD FOR PACKAGING BED

CROSS REFERENCE TO RELATED APPLICATIONS

The present disclosure claims priority to Chinese Patent Application No. 202210147577.X, filed Feb. 17, 2022, and Chinese Patent Application No. 202123194287.0, filed Dec. 16, 2021, which are hereby incorporated by reference herein as if set forth in their entireties.

BACKGROUND

1. Technical Field

The present disclosure relates to the field of furniture, and particular to a method for packaging a bed.

2. Description of Related Art

A bed is a necessary article for daily life of people, and the conventional bed is mainly formed by assembling a headboard, a bed body and the like. Conventional headboards are mostly of integral structure, which is large in size and heavy in weight, inconvenient to disassemble and assemble, and needs to occupy a larger space, which will have adverse effects on shipping and storage.

Shipping and warehousing costs are very sensitive to the packaging size of a shipped object, and excessive size often leads to a dramatic increase in shipping costs. Particularly, for cross-border trade, the shipping of a commodity from a sender to a receiver often involves a combined shipping of multiple shipping modes including air freight, sea freight, and land freight. Since size requirements and charging standards for the shipped objects are different for different countries and regions, different shipping modes, and even different carriers, it is an important task for commodity suppliers to design the packaging size of the commodity more economically. Therefore, it is necessary to optimize and design the structure of the bed, especially the headboard, so as to reduce the packaging size and improve the shipping convenience while ensuring a structural strength.

In the prior art, there have been technical solutions for optimizing headboards to facilitate packaging and shipping. For example, U.S. granted U.S. Pat. No. 7,681,259B2 discloses a detachable headboard, as shown in FIG. 1, the headboard includes a left part 1, a middle part 2, a right part 3, and support columns 4, heights of the two support columns 4 are relatively high, and a bed body is connected to the support columns through connecting members. Such structure can reduce a height size of the headboard and reduce an overall size of the headboard by increasing the height of the support column 4. In addition, the headboard is assembled in multiple pieces, so that the size of the headboard, especially the packaging size, is reduced, thereby facilitating shipping. However, this solution reduces the size and weight of the headboard due to the reduction of the size of the downside of the headboard, but there is no structural support between the longer support columns, adversely affecting the strength of the support columns and the overall headboard. Moreover, this is only to optimize the shipping size and weight of the headboard, which does not play a positive role in the shipping of the bed body, and does not significantly improve the shipping convenience of the whole bed.

BRIEF DESCRIPTION OF THE DRAWINGS

In order to more clearly illustrate the technical solutions in this embodiment disclosure, the drawings used in the embodiments or the description of the prior art will be briefly introduced below. It should be understood that, the drawings in the following description are only examples of the present disclosure. For those skilled in the art, other drawings can be obtained based on these drawings without creative works.

DETAILED DESCRIPTION

Figure 1:
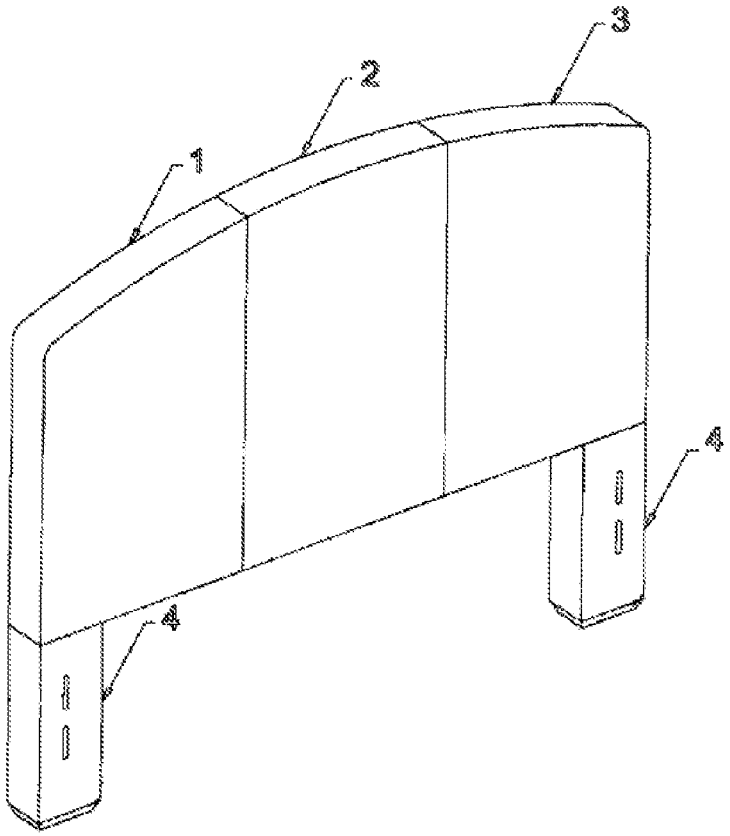
FIG. 1 is a schematic view of a headboard in the prior art.

In order to make the objectives, technical solutions, and advantages of the present disclosure clearer, the present disclosure will be further described in detail below with reference to the drawings and embodiments. It should be understood that, the embodiments described herein are only for explaining the present disclosure and are not intended to limit the present disclosure.

In the description of the present disclosure, it should be understood that orientation or positional conditions indicated by terms "length", "width", "upper", "lower", "front", "rear", "left", "right", "vertical", "horizontal", "top", "bottom", "inner", "outer", "clockwise", "counterclockwise", "axial", "radial", "circumferential" etc. are based on orientation or positional relationships shown in the drawings, which are merely to facilitate the description of the present disclosure and simplify the description, not to indicate or imply that the device or elements must have a particular orientation, be constructed and operated in a particular orientation, and therefore cannot be construed as a limitation on the present disclosure.

In addition, the terms "first" and "second" are used for description only, and cannot be understood as indicating or implying relative importance or implicitly indicating the number of technical features indicated. Thus, the features defined with "first" and "second" may include at least one of the features explicitly or implicitly. In the description of the present disclosure, the meaning of "plurality" is at least two, for example, two, three or the like, unless explicitly and specifically defined otherwise.

In the present disclosure, unless explicitly specified and defined otherwise, terms "mounting", "connecting", "connected", and "fixing" should be understood in a broad sense. For example, it may be a fixed connection or a detachable connection, or an integration; may be a mechanical connection or electrical connection; may be a direct connection, or may be a connection through an intermediate medium, may be the communication between two elements or the interaction between two elements, unless explicitly defined otherwise. The specific meanings of the above terms in the present disclosure can be understood by one of those ordinary skills in the art according to specific circumstances.

Figure 2:
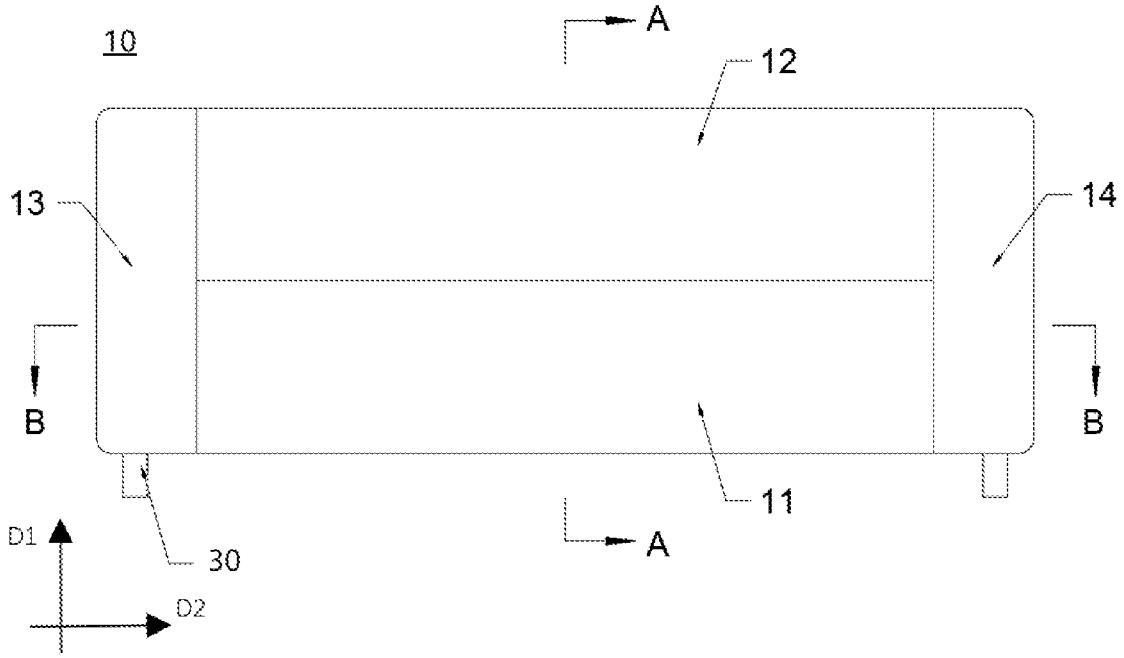
FIG. 2 is a schematic view of a headboard according to an embodiment of the present disclosure.
Figure 3:
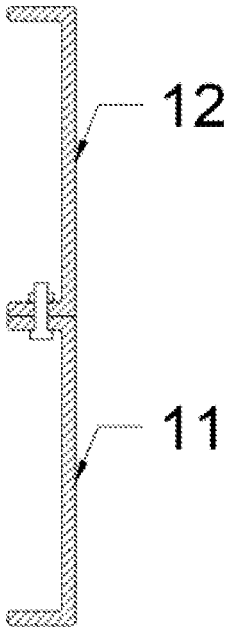
FIG. 3 is a cross-sectional view taken at A-A of FIG. 1.
Figure 4:
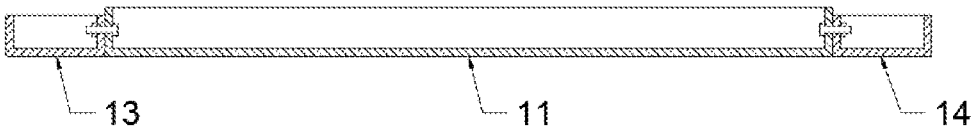
FIG. 4 is a cross-sectional view taken at B-B of FIG. 1.

Referring to FIG. 2 to FIG. 4, a headboard 10 according to an embodiment of the present disclosure includes a first headboard 11, a second headboard 12, a third headboard 13, and a fourth headboard 14. The first headboard 11 is detachably connected to the second headboard 12 along a first direction D1, and the first direction D1 is a vertical direction. The third headboard 13 and the fourth headboard 14 are connected to both sides of the first headboard 11 and the second headboard 12 along a second direction D2. The third headboard 13 and the fourth headboard 14 can be detachably connected to either or both of the first headboard 11 and the second headboard 12, thereby splicing together into a complete headboard.

A splicing seam of the headboard 10 is I-shaped, so that the headboard can well bear forces from different directions, the structure of the whole headboard is more stable, and the headboard is not easy to deform and damage.

The first headboard 11 includes a first panel and a first side panel arranged on the back of the first panel along an edge thereof, and the first side panel and the first panel enclose a first accommodating groove. The second headboard 12 includes a second panel and a second side panel arranged on the back of the second panel along an edge thereof, and the second side panel and the second panel enclose a second accommodating groove. The third headboard 13 includes a third panel and a third side panel arranged on the back of the third panel along an edge thereof, and the third side panel and the third panel enclose a third accommodating groove. The fourth headboard 14 includes a fourth panel and a fourth side panel arranged on the back of the fourth panel along an edge thereof, and the fourth side panel and the fourth panel enclose a fourth accommodating groove. After splicing, front surfaces of the first panel, the second panel, the third panel, and the fourth panel are flush.

A size of the first accommodating groove or the second accommodating groove along a plane where the first direction and the second direction are located is capable of accommodating both the third headboard and the fourth headboard, so that it can be ensured that the first accommodating groove and the second accommodating groove can accommodate all components of a bed body, so as to facilitate shipping. In other words, widths of the first accommodating groove and the second accommodating groove are greater than or equal to a sum of a width of the third headboard and a width of the fourth headboard, and a length of the first accommodating groove is greater than or equal to a length of the third headboard or a length of the fourth headboard.

The first side panel, the second side panel, the third side panel, and the fourth side panel are arranged, so that, on one hand, the panels of the headboard, such as the first panel, the second panel, the third panel, and the fourth panel, can be supported, the structural strength of the headboard can be improved, which provides the possibility for light weight of the panels, and reduces requirements of the structural strength for the thickness of the panel. In addition, since the panel has a larger cross-sectional size, the thickness reduction can significantly reduce the overall weight of the headboard and achieve a lightweight design. On the other hand, the side panels can form accommodating grooves for placing the headboard and various components of the bed body. Through reasonable structural design and fine size control, the whole bed structure can be placed in the first accommodating groove and the second accommodating groove, thereby achieving the optimal packaging size, so that the shipping and warehousing costs of the commodity are minimized. In addition, there is enough space to arrange connecting bolts at contact positions between the first side panel, the second side panel, the third side panel, and the fourth side panel during splicing, so that there is no need to independently arrange a connecting member on the back of the first panel, the second panel, the third panel, and the fourth panel, which simplifies a connecting structure.

To further simplify the manufacturing process and reduce manufacturing and shipping costs, it is preferable that the first headboard and the second headboard are arranged to have exactly the same size, and the third headboard and the fourth headboard are mirror-symmetrical with respect to a center line of the headboard. It is further preferable that the third headboard and the fourth headboard are arranged to have the same size, which can improve the versatility of each component.

The first headboard and the second headboard have the same size, which refers to that the first panel and the second panel have the same size, the first side panel and the second side panel have the same size, and the first accommodating groove and the second accommodating groove have the same size.

Preferably, the first panel and the second panel are rectangular, and cross-sectional shapes of the first accommodating groove and the second accommodating groove along the plane where the first direction and the second direction are located are rectangular.

Preferably, the third panel and the fourth panel are rectangular, and cross-sectional shapes of the third accommodating groove and the fourth accommodating groove along the plane where the first direction and the second direction are located are rectangular.

Preferably, the first panel, the second panel, the third panel, and the fourth panel have the same thickness, the first side panel, the second side panel, the third side panel, and the fourth side panel have the same height in a third direction and have the same thickness in the first direction and the second direction. The third direction is perpendicular to the first direction and the second direction.

In some embodiments, the present disclosure further provides a bed, including the above-mentioned headboard 10 and a bed body 20 detachably connected to the headboard 10. The bed body 20 includes a footboard 21, two side rails 22, a support cross bar, and slats 25. The two side rails 22 are respectively a left side rail and a right side rail having the same size, one end of the side rail 22 is connected to the headboard 10, and the other end thereof is connected to the footboard 21. The support keel includes a transverse keel 23 and a longitudinal keel 24 which are arranged in a crossed manner. Both ends of the transverse keel 23 are connected to the left side rail and the right side rail, respectively. The longitudinal keel 24 is perpendicular to the transverse keel 23, and both ends of the longitudinal keel 24 are connected to the headboard 10 and the footboard 21, respectively, so as to play a role in longitudinal support. Both ends of each of the slats 25 are connected to the side rail 22 and the longitudinal keel 24, respectively. The plurality of slats 25 are evenly arranged at intervals to play a role in supporting mattress.

The various components of the bed body 20 are detachably connected, for example, by screw threads, so that simple mounting and disassembly can be realized.

Further, in order to realize that the components of the bed body 20 can be placed in the accommodating grooves behind the headboard 10, the footboard 21, the side rails 22, and the support keel which have longer sizes can be designed into a multi-section splicing structure.

Specifically, the footboard 21 includes a plurality of detachably connected sub-footboards 211, and the side rail 22 includes a plurality of detachably connected sub-side rails 221. The longitudinal keel 24 includes a first longitudinal keel 241 and a second longitudinal keel 242, both ends of the first longitudinal keel 241 are respectively connected to the headboard 10 and the transverse keel 23, and both ends of the second longitudinal keel 242 are respectively connected to the transverse keel 23 and the footboard 21. The transverse keel 23 includes a first transverse keel 231 connected to the left side rail and a second transverse keel 232 connected to the right side rail.

Lengths of any sub-footboard, any sub-side rail, the first longitudinal keel, and the second longitudinal keel are less than a length of the second accommodating groove. In this way, it can be ensured that the footboard 21, the side rails 22, and the longitudinal keel 24 can be accommodated into the second accommodating groove after being disassembled, and a space of the second accommodating groove can be effectively utilized. It should be noted that, the first headboard is exactly the same size as the second headboard, and those skilled in the art will appreciate that in embodiments of the present disclosure, the first headboard and the second headboard are interchangeable for disassembly, mounting, and packaging. Therefore, the second accommodating groove described herein and hereinafter can also be replaced by the first accommodating groove, which does not change the intent of the present disclosure.

Preferably, the number of the sub-footboards is two, any one of the side rails 22 is composed of two sub-side rails 221, each of the sub-footboards 211 has the same size, and each of the sub-side rails 221 has the same size. The first longitudinal keel 241 and the second longitudinal keel 242 have the same size, and the first transverse keel 231 and the second transverse keel 232 have the same size.

Preferably, any sub-footboard 211 and any sub-side rail 221 have the same width, and a width of the second accommodating groove is greater than or equal to 3 times of that of any sub-footboard 211.

Preferably, a thickness of any sub-footboard 211 is greater than a thickness of any sub-side rail 221.

Preferably, a thickness difference between the sub-footboard 211 and the sub-side rail 221 is greater than or equal to one of a width or a height of the longitudinal keel 24.

Preferably, lengths of any slat 25, the first transverse keel 231, and the second transverse keel 232 are less than a length of the third accommodating groove.

Figure 5:
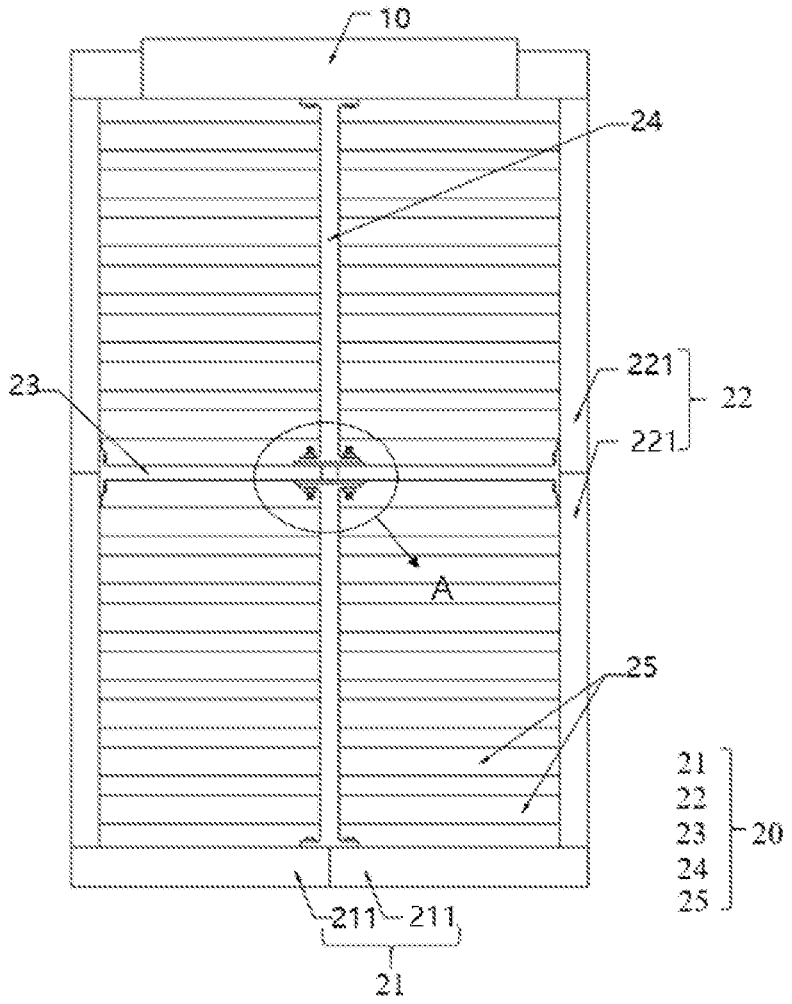
FIG. 5 is a schematic view of a bed according to an embodiment of the present disclosure.

As shown in FIG. 5, the longitudinal keel 24 includes a first longitudinal keel 241 and a second longitudinal keel 242. Both ends of the first longitudinal keel 241 and the second longitudinal keel 242 are provided with mounting end surfaces, respectively, and a cross-sectional area of the mounting end surface is greater than cross-sectional areas of the first longitudinal keel 241 and the second longitudinal keel 242. The mounting end surface is provided with a plurality of mounting holes for bolts to pass through. A gasket 243 is provided between the mounting end surface and the transverse keel 23, and the gasket 243 can improve the tightening effect of the bolts and adjust a mounting clearance.

The transverse keel 23 includes a first transverse keel 231 and a second transverse keel 232. The mounting end surfaces are provided on sides of the first transverse keel 231 and the second transverse keel 232 that are butted with the side rails 22. The first transverse keel 231 and the second transverse keel 232 are connected by an intermediate connecting block 233, the intermediate connecting block 233 can be provided with plug-in structures matched with the first transverse keel 231 and the second transverse keel 232 at both side surfaces thereof, respectively, so as to realize detachable connection.

Further, the bed further includes a plurality of support legs 30, which detachably support the headboard, the footboard, the side rails, and the support keel, respectively.

As shown in FIG. 2, the two support legs 30 are detachably connected to the lower side surfaces of the third headboard and the fourth headboard, respectively, and are used for supporting the headboard 10.

For the support legs for supporting the footboard, the side rails, and the support keel, it is preferable that the support legs 30 are arranged below a splicing position of the two sub-side rails 221, below a splicing position of the two sub-footboards 211, and below a splicing position of the first transverse keel 231 and the second transverse keel 232. Such arrangement of the support legs can not only support the whole bed, but also strengthen a connection strength between the plurality of sub-footboards and the plurality of sub-side rails, improve a structural strength of the footboard and the side rails, thereby ensuring a more stable force.

Figure 6:
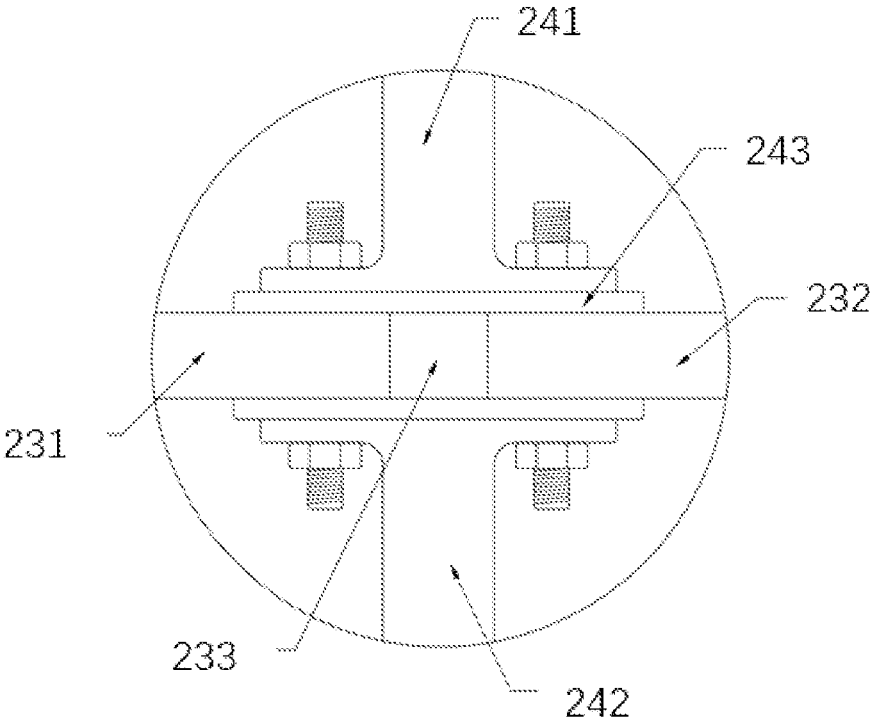
FIG. 6 is a partial enlarged view of a portion A in FIG. 5.
Figure 7:
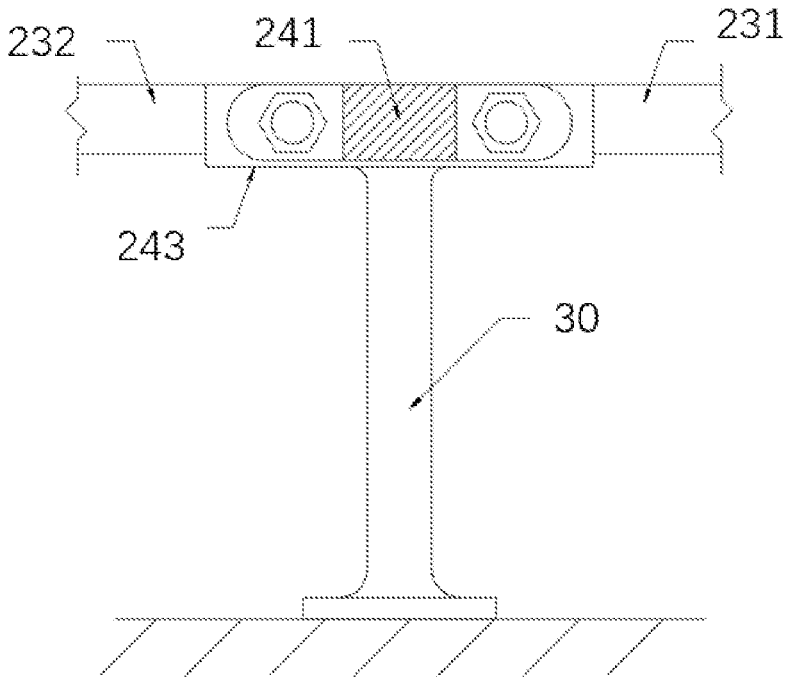
FIG. 7 is a side view of a connection of a transverse keel and a longitudinal keel according to an embodiment of the present disclosure.
Figure 8:
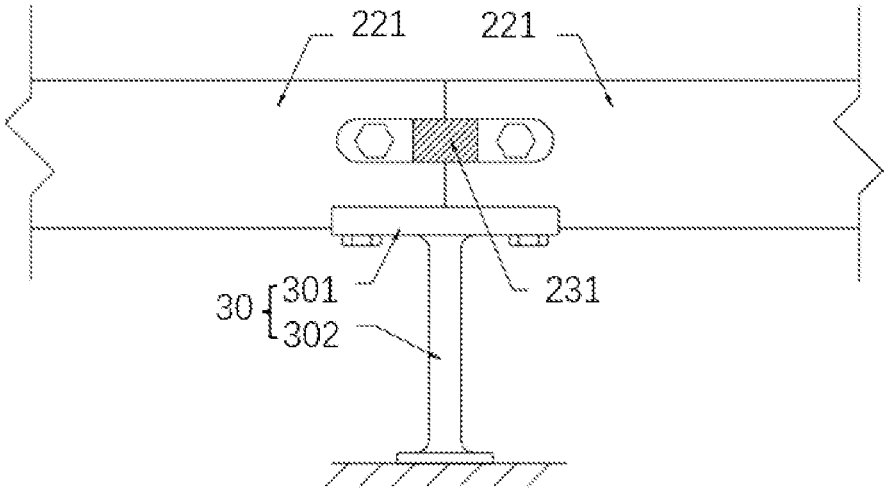
FIG. 8 is a side view of a connection of a transverse keel and a side rail according to an embodiment of the present disclosure.
Figure 9:
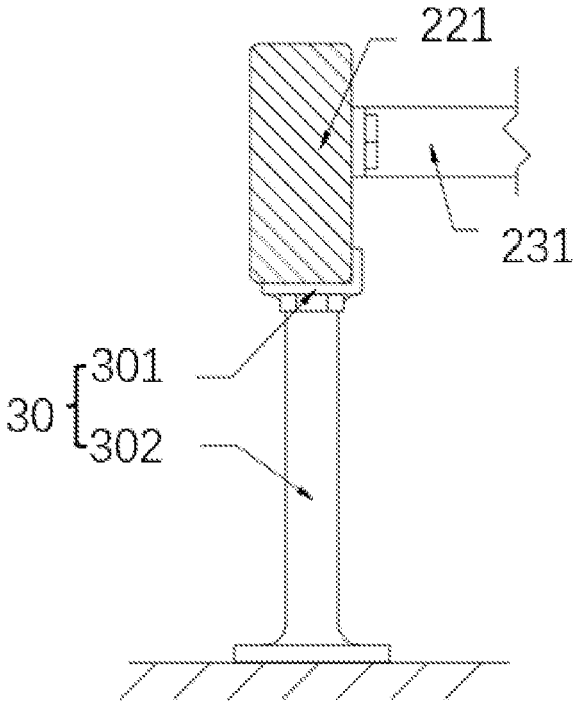
FIG. 9 is another side view of a connection of a transverse keel and a side rail according to an embodiment of the present disclosure.

As shown in FIGS. 6 to 8, the support leg 30 is disposed below a position where the first transverse keel 231 and the second transverse keel 232 are connected. The support leg 30 includes a connecting end 301 and a support column 302, and the connecting end 301 is detachably connected to lower side surfaces of the first transverse keel and the second transverse keel, such as bolted connection. Since an upper surface of the connecting end of the support leg 30 is in contact with the lower side surfaces of the first transverse keel 231 and the second transverse keel 232 at the same time, the supporting effect can be well achieved, and structural damage caused by uneven force at a connecting portion of the first transverse keel 231 and the second transverse keel 232 is avoided.

Preferably, a cross-section of the connecting end 301 can be in an "L" shape, including a horizontal portion and a vertical portion that are arranged perpendicular to each other, so that in addition to an upper surface of the horizontal portion supporting the upper structure, the vertical surface can play a limiting role. In this way, it can play a good positioning role during mounting, and it can also avoid the dislocation deformation caused by the inconsistent displacement caused by the force at the splicing of the components of the bed body during use, which affects the service life.

In this embodiment, the headboard and the bed body are divided into a plurality of sub-parts, in particular, a single headboard with a larger size is reasonably disassembled, and the accommodation grooves are provided on the backs of the disassembled sub-sections, so that each component of the bed body can be disassembled and placed in the accommodating grooves during shipping, which can minimize the shipping size of the disassembled bed and reduce the shipping cost.

The headboard provided by the embodiments of the present disclosure can be formed by detachably splicing the first headboard, the second headboard, the third headboard, and the fourth headboard, and the backs of the first headboard and the second headboard are respectively provided with the accommodating grooves. In this way, the third headboard, the fourth headboard, and the bed body can be placed into the accommodating grooves after being detached, so that the whole bed can be integrated and reduced to the size of the stacking of the lower headboard and the upper headboard. The technical scheme of the present disclosure completely maintains the overall size of the headboard, ensures the structural strength of the headboard, and in addition, can minimize the packaging size, meet the size requirements of remote shipping and warehousing, and improve the shipping economy of the product.

Figure 10:
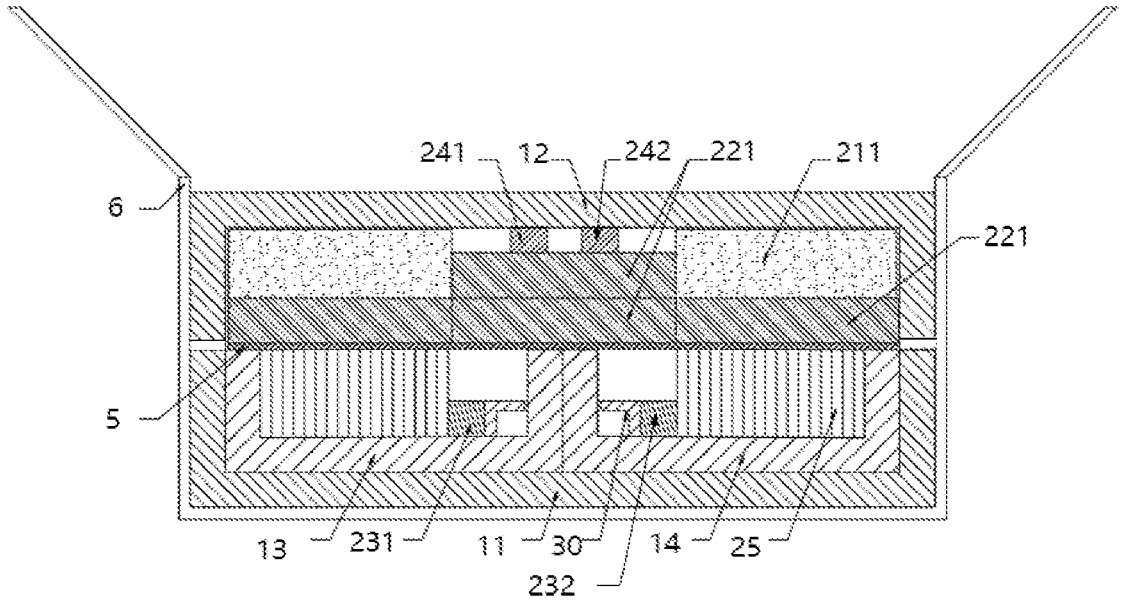
FIG. 10 is a schematic view of a bed after packaging.

Preferably, an embodiment of the present disclosure further provides a method for packaging a bed, as shown in FIG. 10, the bed includes a headboard 10 and a bed body 20, and the method specifically includes the following steps.

At S1: the headboard 10 is disassembled into a first headboard 11, a second headboard 12, a third headboard 13, and a fourth headboard 14, one of the first headboard 11 and the second headboard 12 is placed with the back thereof facing upward to allow an opening of the first accommodating groove or the second accommodating groove on the back thereof to face upward, and the third headboard 13 and the fourth headboard 14 are placed side by side with their back facing upward into the accommodating groove, and openings of the third accommodating groove and the fourth accommodating groove are allowed to face upward.

At S2, the slats 25 are vertically placed into the third accommodating groove and the fourth accommodating groove after being stacked, and the first transverse keel 231, the second transverse keel 232, and the support legs 30 are evenly divided into two groups to be respectively placed into the third accommodating groove and the fourth accommodating groove.

At S3, the side rails 22 are disassembled into four sub-side rails 221 having the same size, the footboard 21 is disassembled into two sub-footboards 211 having the same size, any three of the four sub-side rails 221 are tiled above the third headboard 13 and the fourth headboard 14, and then the remaining fourth sub-side rail 221 and the two sub-footboards 211 are continued to be tiled thereon.

At S4, the first longitudinal keel 241 and the second longitudinal keel 242 are placed on an upper surface of the fourth sub-side rail, so that upper surfaces of the first longitudinal keel 241, the second longitudinal keel 242, and the sub-footboards 211 are flush.

At S5, the accommodating cavity on the back of the other of the first headboard 11 and the second headboard 12 is covered on upper surfaces of the two sub-footboards 211, the first longitudinal keel 241, and the second longitudinal keel 242 with the opening facing downward.

Further, the hardware for mounting is placed into the third accommodating groove and/or the fourth accommodating groove during packaging.

Further, before the sub-side rails are placed, a cushion layer 5 is placed above the third headboard 13 and the fourth headboard 14, and the cushion layer 5 is used for separating the sub-side rails from the slats 25, the third headboard 13, and the fourth headboard 14. The cushion layer 5 can be specifically made of sponge or foam material, and the cushion layer 5 is provided to facilitate cushioning and shock absorption and avoid damage during shipping.

Further, the step S1 further includes: providing a packing box 6, and placing one of the first headboard 11 and the second headboard 12 on an inner bottom surface of the packing box 6 with the back facing upward. A size of the inner bottom surface of the packing box 6 is preferably the same as that of the first panel or the second panel.

By adopting the above packaging method, the shipping size of the bed can be minimized, the warehousing and shipping costs can be significantly saved, and the economy of the product can be improved.

Take a bed having a size of 218 cm×160 cm×110 cm that is currently commonly found on the market as an example. A size of the headboard is 160 cm×100 cm×7.5 cm, a size of the footboard is 160 cm×15 cm×5 cm, sizes of the side rails are 205 cm×15 cm×3 cm, a size of the transverse keel is 154 cm×2 cm×2 cm, sizes of the first longitudinal keel and the second longitudinal keel in the longitudinal keel are both 101.5 cm×4 cm×2 cm, sizes of the slats are 77 cm×5.3 cm×0.9 cm, and the number of the slats is 28.

According to the technical solutions of the above-mentioned embodiments of the present disclosure, sizes of the first headboard 11 and the second headboard 12 after the headboard 10 is disassembled are 114 cm×50 cm×7.5 cm, and sizes of the first accommodating groove and the second accommodating groove at the back thereof are 110 cm×46 cm×6 cm. Sizes of the third headboard 13 and the fourth headboard 14 are 100 cm×23 cm×6 cm, and sizes of the third accommodating groove and the fourth accommodating groove are 96 cm×19 cm×4.5 cm. The footboard can be disassembled into two sub-footboards with the same size, both of which have a size of 80 cm×15 cm×5 cm. Any one of the side rails can be disassembled into two sub-side rails with the same size, both of which have a size of 102.5 cm×15 cm×3 cm. The transverse keel is disassembled into a first transverse keel and a second transverse keel with the same size, both of which have a size of 77 cm×2 cm×2 cm.

In this way, when viewed from a length direction, lengths of the first accommodating groove and the second accommodating groove can be enough to accommodate lengths of all other components. When viewed from a width direction, a width of any one of the first accommodating groove and the second accommodating groove is greater than or equal to a sum of widths of the third headboard and the fourth headboard, or greater than or equal to a sum of widths of three of the plurality of sub-side rails and the sub-footboards. A difference between the thickness of any sub-footboard and the thickness of any sub-side rail is equal to the width or height of the longitudinal keel.

According to the packaging method described in the above embodiments, the bed body is disassembled, stacked, and placed in a packing box to form a final packaging size of 116 cm×52 cm×21 cm.

The size requirements and costs of goods will be further described below in connection with logistics and warehousing companies. In cross-border trade, the goods need to be shipped from domestic exporters to foreign transfer warehouses by air freight or sea freight, and the cost incurred at this stage is first-way freight, mainly including air or sea freight, and storage costs. Then the goods are shipped from the transfer warehouse to the location of a buyer by a courier company by land freight, and the cost incurred here is the final-way freight. Therefore, the shipping cost in a single trade activity is mainly composed of the first-way freight and the final-way freight.

Since the sea freight is much lower, taking the sea freight as an example herein, the biggest factor affecting the sea freight is the volume of the product package. The greater the quantity of products that can be loaded in a single container, the less the shipping costs will be shared on a single product. The warehousing cost is a storage cost of the transfer warehouse, and is mainly charged according to the packaging size of the product, such as size of the longest side, the length plus the perimeter and the weight. The final-way freight is charged by the courier company according to the product package and size and the shipping distance. Since the courier companies need to use freight vehicles for shipping, requirements on the packaging size and weight of products are stricter, and a lot of extra costs will be incurred when the size or weight exceeds the standard.

Taking the size requirements of Amazon's US FBA warehouse, and Fedex or UPS companies as an example, as shown in the following table:

| Single Stock Keeping Unit (SKU) | | single box requirement of Amazon | | delivery box requirement of courier |
|---|---|---|---|---|
| Size/cm | Weight/kg | Size/cm | Weight/kg | Size/cm |
| Longest side < 63.5 | <22.5 | Longest side < 63.5 and length + 2 width + 2 height < 330 | <22.5 | 120 × 75 × 75 and length + 2 width + 2 height < 266 |
| Longest side < 63.5 | 22.5 < X < 68 | Longest side < 63.5 and length + 2 width + 2 height < 330 | 22.5 < X < 68 | 120 × 75 × 75 and length + 2 width + 2 height < 266 |
| 63.5 < Longest side < 120 | <22.5 | length + 2 width + 2 height < 330 | <22.5 | 120 × 75 × 75 and length + 2 width + 2 height < 266 |
| 63.5 < Longest side < 120 | 22.5 < X < 68 | length + 2 width + 2 height < 330 | 22.5 < X < 68 | 120 × 75 × 75 and length + 2 width + 2 height < 266 |
| 120 < Longest side < 243 | <22.5 | length + 2 width + 2 height < 330 | <22.5 | 121 < Longest side < 243 and length + 2 width + 2 height < 266 |
| 120 < Longest side < 243 | 22.5 < X < 68 | length + 2 width + 2 height < 330 | 22.5 < X < 68 | 121 < Longest side < 243 and length + 2 width + 2 height < 266 |
| 243 < Longest side < 274 | <22.5 | length + 2 width + 2 height < 419 | <22.5 | 243 < Longest side < 274 and length + 2 width + 2 height < 419 |
| 243 < Longest side < 274 | 22.5 < X < 68 | length + 2 width + 2 height < 419 | 22.5 < X < 68 | 243 < Longest side < 274 and length + 2 width + 2 height < 419 |

The weight of the bed is usually in a range of 22.5 kg to 68 kg, so that for the packaging size, if economy is to be ensured, it is necessary that the size of the longest side can be controlled to be within 120 cm, and the perimeter size (length +2 width +2 height) can be controlled to be within 330 cm. Further, considering the size requirement of the delivery box of the courier company, it is necessary that the perimeter size (length +2 width +2 height) of the package can be controlled to be within 266 cm, otherwise the shipping cost will increase rapidly.

Still taking a bed with a size of 218 cm×160 cm×110 cm as an example, three sets of comparative examples are illustrated using three different structures of headboard and packaging methods.

Comparative Example 1

By using the structure of the headboard and the packaging method described by the embodiment of the present disclosure, as shown in FIG. 2, the headboard is disassembled into four pieces according to the I-shaped splicing seam, the back of each piece of the headboard is provided with the accommodating groove, and the bed body is placed into the accommodating groove after being detached, and is folded and stacked into the packing box. A wall thickness of the packing box is 1 cm, and an overall size after a final packaging is 116 cm×52 cm×21 cm.

Comparative Example 2

The headboard is not disassembled, the whole headboard is used as a single component, a size of the headboard is 160 cm×100 cm×7.5 cm. Similarly, an accommodating groove is also arranged at the back of the headboard. The bed body still adopts the structure described in the foregoing embodiments of the present disclosure. The bed body is disassembled and then placed in the accommodating groove, and finally placed in the packing box. A side wall thickness of the packing box is 1 cm, and an overall size after a final packaging is 162 cm×102 cm×10 cm.

Comparative Example 3

The headboard is disassembled into an upper headboard and a lower headboard which have the same shape, a size of each headboard is 160 cm×50 cm×7.5 cm. Similarly, an accommodating groove is also arranged at the back of the headboard. The bed body still adopts the structure described in the foregoing embodiments of the present disclosure. The bed body is disassembled and then placed in the accommodating groove, and the upper headboard and the lower headboard are combined. The specific arrangements of the accommodating groove and the bed body are described with reference to the foregoing embodiments, and will not be described herein again. A side wall thickness of the packing box is 1 cm, and an overall size after a final packaging is 165 cm×52 cm×21 cm.

Based on the current shipping size requirements and cost standards, shipping costs for the three comparative examples can be derived as follows:

| Type | packaging size/cm | Volume/ $m^3$ | Longest side/cm | Length + 2 width + 2 height/cm | First-way freight/rmb | Final-way freight/USD |
|---|---|---|---|---|---|---|
| Comparative Example 1 | 116 × 52 × 21 | 0.12667 | 116 | 262 | 245.5488 | 33.74 |
| Comparative Example 2 | 162 × 102 × 10 | 0.16524 | 162 | 386 | 320.31138 | 76.57 |
| Comparative Example 3 | 165 × 52 × 21 | 0.18018 | 165 | 311 | 349.272 | 42.57 |

It can be seen from the above table that, using the packaging size of Comparative Example 1, the volume, size of the longest side, and perimeter size (length +2 width +2 height) thereof are significantly smaller than those of Comparative Examples 2 and 3. Particularly, the perimeter size (length +2 width +2 height) in Comparative Example 1 can not only meet the requirement of not more than 330 cm stipulated by Amazon's US FBA warehouse, but also meet the requirement of not more than 266 cm required by courier companies such as Fedex or UPS company. Such size can adapt to the shipping requirements of various countries and various shipping links in cross-border logistics, and avoid affecting warehousing and delivery due to size problems or incurring additional costs. Obviously, the structural design and packaging method of Comparative Example 1 can significantly reduce shipping and warehousing costs, and have extremely high economic benefits compared to solutions in the prior art.

The above-mentioned embodiments are merely intended for describing but not for limiting the technical schemes of the present disclosure. Although the present disclosure is described in detail with reference to the above-mentioned embodiments, it should be understood by those skilled in the art that, the technical schemes in each of the above-mentioned embodiments may still be modified, or some of the technical features may be equivalently replaced, while these modifications or replacements do not make the essence of the corresponding technical schemes depart from the spirit and scope of the technical schemes of each of the embodiments of the present disclosure, and should be included within the scope of the present disclosure.

What is claimed is:

1. A method for packaging a bed, comprising:

a step S1: disassembling a headboard into a first headboard, a second headboard, a third headboard, and a fourth headboard; placing one of the first headboard and the second headboard with a back thereof facing upward to allow an opening of a first accommodating groove or a second accommodating groove on the back thereof to face upward; placing the third headboard and the fourth headboard side by side with a back thereof facing upward into the first accommodating groove or the second accommodating groove, and allowing openings of a third accommodating groove and a fourth accommodating groove to face upward;

a step S2: vertically placing stacked slats into the third accommodating groove and the fourth accommodating groove, and evenly dividing a first transverse keel, a second transverse keel, and support legs into two groups to be respectively placed into the third accommodating groove and the fourth accommodating groove;

a step S3: disassembling side rails into four sub-side rails having a same size, disassembling a footboard into two sub-footboards having a same size; tiling any three of the four sub-side rails above the third headboard and the fourth headboard, and then tiling a remaining sub-side rail and the two sub-footboards thereon;

a step S4: placing a first longitudinal keel and a second longitudinal keel on an upper surface of the remaining sub-side rail, so that upper surfaces of the first longitudinal keel, the second longitudinal keel, and the sub-footboards are flush; and a step S5: covering an accommodating cavity on a back of the other of the first headboard and the second headboard on upper surfaces of the two sub-footboards, the first longitudinal keel, and the second longitudinal keel with an opening of the accommodating cavity facing downward.

2. The method of claim 1, wherein the step S1 further comprises: providing a packing box, and placing one of the first headboard and the second headboard on an inner bottom surface of the packing box with the back facing upward;

wherein a size of the packing box after the packaging is 116 cm×52 cm×21 cm.

* * * * *